US009606499B2

(12) United States Patent
Hayamizu

(10) Patent No.: US 9,606,499 B2
(45) Date of Patent: Mar. 28, 2017

(54) HEATING DEVICE AND IMAGE FORMING APPARATUS

(71) Applicant: KYOCERA Document Solutions Inc., Osaka (JP)

(72) Inventor: Hitoshi Hayamizu, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/007,777

(22) Filed: Jan. 27, 2016

(65) Prior Publication Data

US 2016/0223957 A1 Aug. 4, 2016

(30) Foreign Application Priority Data

Jan. 29, 2015 (JP) ..... 2015-015645

(51) Int. Cl.
*G03G 15/00* (2006.01)
*H05B 1/00* (2006.01)
(Continued)

(52) U.S. Cl.
CPC ..... *G03G 15/80* (2013.01); *G03G 21/203* (2013.01); *H05B 1/00* (2013.01); *H05B 1/0241* (2013.01); *G03G 2215/00666* (2013.01)

(58) Field of Classification Search
CPC .... H01B 1/00; H01B 1/0241; G03G 15/2007; G03G 15/2039; G03G 15/2057; G03G 15/206; G03G 2215/2035
(Continued)

(56) References Cited

U.S. PATENT DOCUMENTS

2005/0006370 A1* 1/2005 Suzumi ..... H05B 3/0095 219/216
2005/0280682 A1* 12/2005 Kato ..... B41J 11/002 347/102
(Continued)

FOREIGN PATENT DOCUMENTS

JP H04-077883 U 7/1992
JP H04-109776 U 9/1992
(Continued)

OTHER PUBLICATIONS

Notice of Reasons for Refusal mailed by Japan Patent Office on Jun. 28, 2016 in the corresponding Japanese patent application No. 2015-015645.

*Primary Examiner* — Walter L Lindsay, Jr.
*Assistant Examiner* — Jessica L Eley
(74) *Attorney, Agent, or Firm* — IP Business Solutions, LLC

(57) ABSTRACT

A heating device includes a plurality of chip resistors, a conductor pattern, and a substrate. The plurality of chip resistors generate heat upon receiving power from a power source. The conductor pattern is arranged so as to serially connect the plurality of chip resistors. The conductor pattern is formed on the substrate. The conductor pattern connecting the chip resistors is wider in a forward path from the power source than in a backward path. The majority of the heat generated by the chip resistor is transmitted from the chip resistor to the conductor pattern, and the transmitted heat is radiated from the conductor pattern. Thus, not only the heat from the surface of the chip resistor but also the heat from the conductor pattern serves as heat source.

6 Claims, 4 Drawing Sheets

(51) Int. Cl.
*H05B 1/02* (2006.01)
*G03G 21/20* (2006.01)

(58) Field of Classification Search
USPC ..... 399/122, 328, 333–335
See application file for complete search history.

(56) References Cited

U.S. PATENT DOCUMENTS

| | | | | |
|---|---|---|---|---|
| 2009/0230114 | A1* | 9/2009 | Taniguchi | G03G 15/2042 219/216 |
| 2013/0251428 | A1* | 9/2013 | Ueno | H05B 3/12 399/333 |

FOREIGN PATENT DOCUMENTS

| | | | |
|---|---|---|---|
| JP | H10224002 | A | 8/1998 |
| JP | 2000-301767 | A | 10/2000 |
| JP | 2013200945 | A | 10/2013 |

* cited by examiner

HEATING DEVICE AND IMAGE FORMING APPARATUS

INCORPORATION BY REFERENCE

This application claims priority to Japanese Patent Application No. 2015-015645 filed on Jan. 29, 2015, the entire contents of which are incorporated by reference herein.

BACKGROUND

The present disclosure relates to a heating device and an image forming apparatus.

Many of current image forming apparatuses adopt an electrophotography process that includes, for example, uniformly charging a photosensitive body not carrying electric charge (charging process), irradiating the surface of the photosensitive body which has been charged with a laser beam according to a source document to be copied, thereby forming a latent image of the source document on the surface of the photosensitive body (exposing process), visualizing the latent image with a toner (developing process), transferring the toner image formed by the visualization onto a recording medium, such as a recording sheet, placed on a transfer belt (transfer process), and fixing the transferred toner image on the recording medium (fixing process). When the image forming operation is performed under high humidity with the image forming apparatus based on the electrophotography, dew condensation may take place on the surface of the photosensitive body, which may cause an image blur thereby degrading the printing quality. Accordingly, some of the image forming apparatuses are configured to perform dehumidification, including rotating the photosensitive body for a few minutes, when the humidity is higher than a predetermined threshold, in order to remove the moisture before starting the image forming operation.

SUMMARY

Accordingly, the disclosure proposes further improvement of the foregoing technique.

In an aspect, the disclosure provides a heating device including a plurality of heat generators, a conductor pattern, and a substrate.

The plurality of heat generators generate heat upon receiving power from a power source.

The substrate includes the conductor pattern.

The conductor pattern is arranged so as to serially connect the plurality of heat generators to thereby supply the power from the power source to each of the heat generators. The conductor pattern is wider in a forward path from the power source than in a backward path.

In another aspect, the disclosure provides an image forming apparatus including the foregoing heating device, and an image forming unit.

The image forming unit forms a toner image on a surface of a photosensitive body, and transfers the toner image onto a recording medium.

The heating device is located in a vicinity of the photosensitive body.

DETAILED DESCRIPTION

Figure 1:
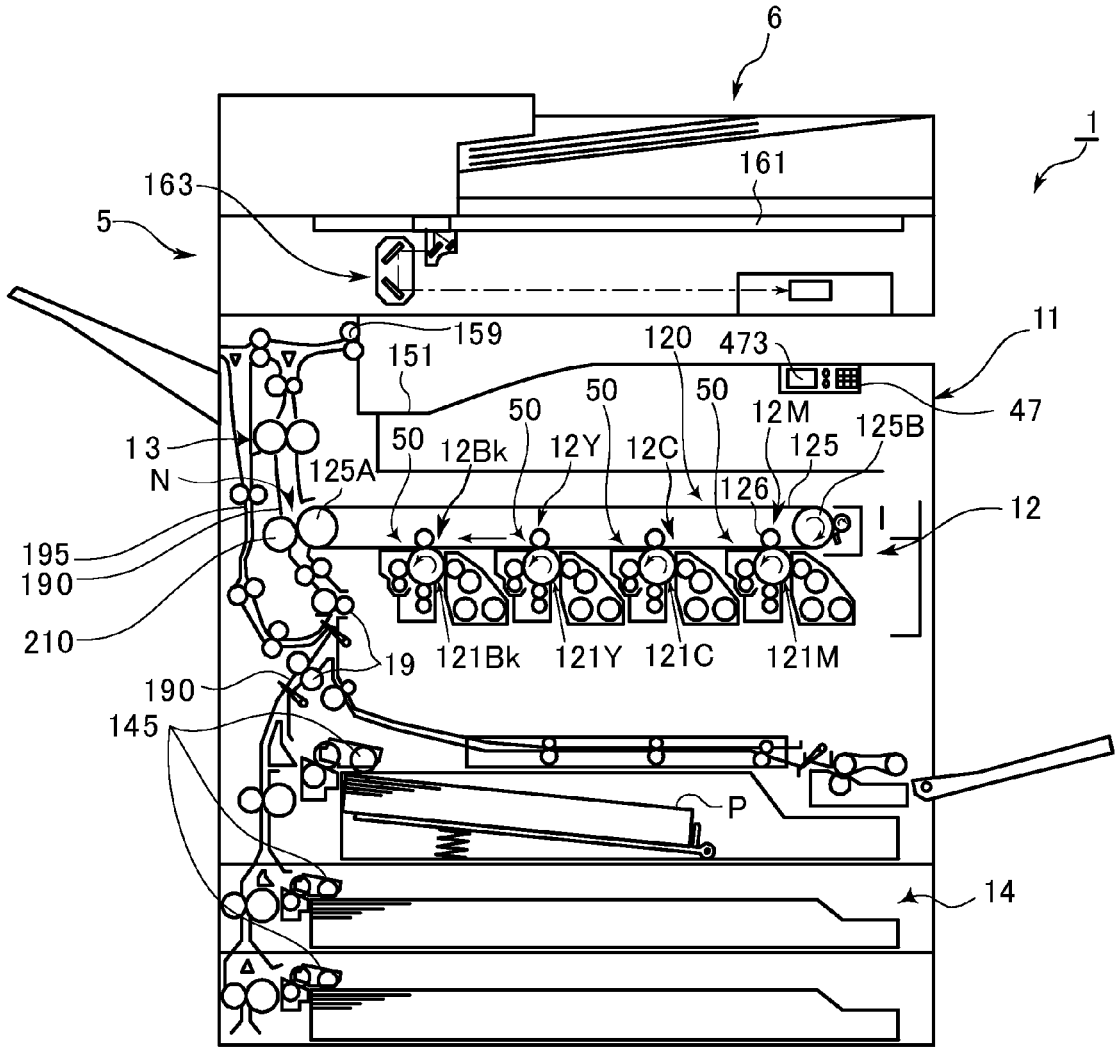
FIG. 1 is a partially cut away front view showing a configuration of an image forming apparatus according to an embodiment of the disclosure.

Hereafter, an embodiment of a heating device and an image forming apparatus including the heating device according to the disclosure will be described with reference to the drawings. FIG. 1 is a partially cut away front view showing a configuration of the image forming apparatus according to the embodiment of the disclosure.

The image forming apparatus 1 according to the embodiment of the disclosure is a multifunction peripheral having a plurality of functions, such as copying, printing, scanning, and facsimile transmission. The image forming apparatus 1 includes an operation unit 47, a document feeder 6, and a document reader 5, which are mounted inside a main body 11.

The operation unit 47 receives instructions from the user, for operations and processes that the image forming apparatus 1 is configured to perform, such as image forming and document reading, and includes a display unit 473 for displaying a guidance and so forth to the operator.

In the image forming apparatus 1, the document reading operation is performed as follows. The document reader 5 optically reads the image on a source document delivered from the document feeder 6 or placed on a platen glass 161, and generates image data. The image data generated by the document reader 5 is stored in a built-in hard disk drive (HDD) or a computer connected to a network.

In the image forming apparatus 1, the image forming operation is performed as follows. An image forming unit 12 forms a toner image on a sheet P serving as a recording medium and delivered from a paper feed unit 14, on the basis of the image data generated through the document reading operation and the image data stored in the built-in HDD or received from the computer connected to the network.

The image forming unit 12 includes an image forming subunit 12M for magenta (M), an image forming subunit 12C for cyan (C), an image forming subunit 12Y for yellow (Y), and an image forming subunit 12Bk for black (Bk). The image forming subunits 12M, 12C, 12Y, 12Bk respectively include drum-shaped photoconductor drums 121M, 121C, 121Y, and 121Bk, which are configured to rotate counterclockwise in FIG. 1. Here, the photoconductor drums 121M, 121C, 121Y, and 121Bk correspond to the photosensitive body in the disclosure.

The image forming unit 12 also includes a transfer unit 120, including an intermediate transfer belt 125 on an outer circumferential surface of which the toner image is transferred, a drive roller 125A, a slave roller 125B, and a primary transfer roller 126.

The intermediate transfer belt 125 is wound over the drive roller 125A and the slave roller 125B, to be driven by the drive roller 125A in contact with the circumferential surface of the photoconductor drums 121M, 121C, 121Y, and 121Bk thus to endlessly run in synchronization with the photoconductor drums 121M, 121C, 121Y, and 121Bk.

Hereunder, a color printing operation will be described. The respective circumferential surfaces of the photoconductor drums 121M, 121C, 121Y, and 121Bk are uniformly charged (charging process), the surfaces of the photoconductor drums 121M, 121C, 121Y, and 121Bk which have been charged are irradiated with a laser beam according to the image data, to form the latent image (exposing process), the latent image is visualized with a toner (developing process), and then the toner image formed by the visualization is transferred onto the intermediate transfer belt 125, via the primary transfer roller 126.

The toner images of the respective colors (magenta, cyan, yellow, and black) to be transferred onto the intermediate transfer belt 125 are superposed at an adjusted timing on the intermediate transfer belt 125, so as to form a colored toner image.

A secondary transfer roller 210 transfers the colored toner image formed on the surface of the intermediate transfer belt 125 onto the sheet P transported along a transport route 190 from the paper feed unit 14, at a nip region N of a drive roller 125A engaged with the intermediate transfer belt 125. Here, the description thus far given refers to the color printing. In the case of monochrome printing, only the photoconductor drum 121Bk for black is employed, without using the photoconductor drums 121M, 121C, and 121Y for magenta, cyan, and yellow.

A fixing unit 13 serves to fix the toner image on the sheet P by thermal compression, and the sheet P that has undergone the fixing process, now having the color image formed thereon, is outputted to an output tray 151.

The paper feed unit 14 includes a plurality of paper cassettes, and pickup rollers 145 for picking up the recording sheet placed on the respective paper cassettes, and is configured to pick up the recording sheet of the size designated by the user, by rotating the corresponding pickup roller 145, to transport the designated recording sheet to the nip region N.

In the image forming apparatus 1, a duplex printing operation is performed as follows. The sheet P having an image formed by the image forming unit 12 on one surface is nipped between a discharge roller pair 159, and then switched back by the discharge roller pair 159 to be delivered to a reverse transport route 195 and is again transported by a transport roller pair 19 to the upstream side with respect to the transport direction. Thus, the image is also formed on the other surface of the sheet P, by the image forming unit 12.

The photoconductor drums 121M, 121C, 121Y, and 121Bk each include a static eliminator 50 that removes the residual electric charge, by irradiating the surface of the photoconductor drum 121M, 121C, 121Y, and 121Bk with a static eliminating light after the image forming operation performed by the image forming subunits 12M, 12C, 12Y, and 12Bk.

Figure 2:
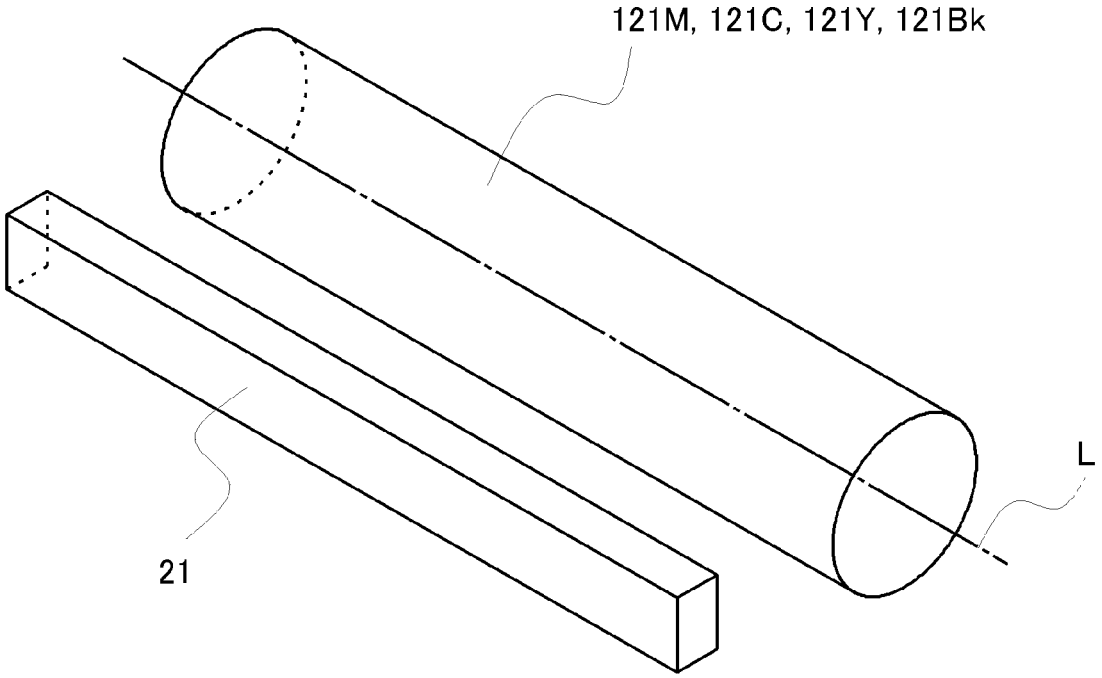
FIG. 2 is a schematic perspective view of a heating device and the periphery thereof of the image forming apparatus according to the embodiment of the disclosure.

FIG. 2 is a schematic perspective view of the heating device and the periphery thereof of the image forming apparatus according to the embodiment of the disclosure. The heating device 21 is disposed in the vicinity of each of the photoconductor drums 121M, 121C, 121Y, and 121Bk parallel to the rotational axis L, and serves to heat up the surrounding air to thereby warm the surface of the photoconductor drums 121M, 121C, 121Y, and 121Bk, thus dehumidifying the same.

Figure 3:
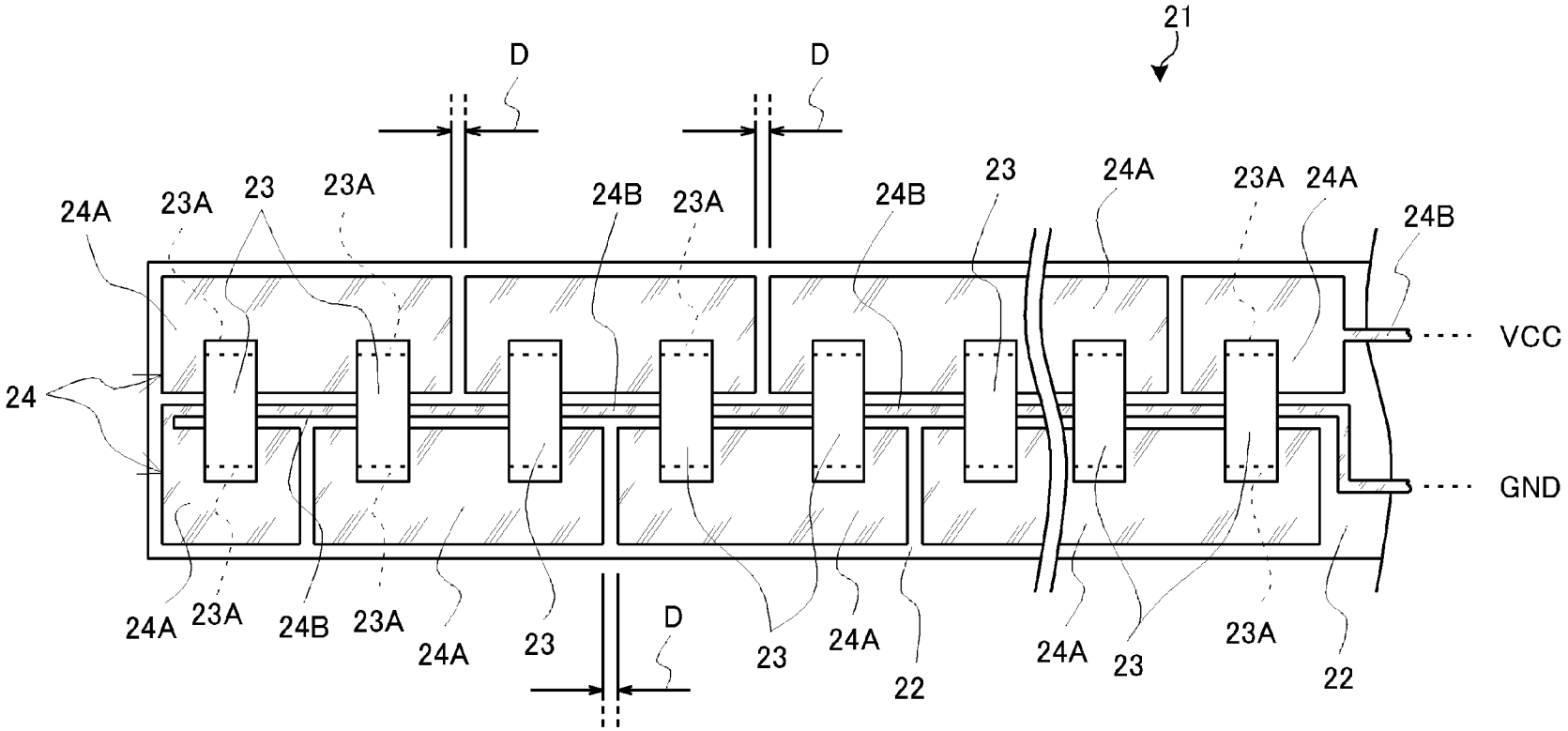
FIG. 3 is a schematic drawing showing an essential part of the heating device of the image forming apparatus according to the embodiment of the disclosure.

FIG. 3 is a schematic drawing showing an example of the heating device 21. The heating device 21 includes a substrate 22 on which an electronic circuit is implemented. On the substrate 22, a plurality of chip resistors 23 that generate heat by receiving power from a power source VCC are aligned in a row at equal intervals. The plurality of chip resistors 23 are connected in series via a conductor pattern 24 formed of, for example, a thin copper foil. Thus, the conductor pattern 24 connects the chip resistors 23 in series to supply the power from the power source VCC to each of the chip resistors 23. An end of the conductor pattern 24 is connected to the power source VCC, and the other end of the conductor pattern 24 is grounded. Here, the substrate 22, the chip resistor 23, and the conductor pattern 24 correspond to the substrate, the heat generator, and the conductor pattern in the disclosure, respectively.

The conductor pattern 24 is wider in its forward path from the power source VCC, than in its backward path. In other words, a conductor element 24A, constituting the forward path in the vicinity of a joint 23A between the chip resistor 23 and the conductor pattern 24, is wider than a conductor element 24B constituting the backward path, in the conductor pattern 24.

Here, it is preferable that intervals D between the conductor elements 24A are of the same size, so that the conductor elements 24A are aligned at equal intervals. In this embodiment, the conductor pattern 24 is formed such that the intervals D between the conductor elements 24A are of the same size, in other words the conductor elements 24A are evenly disposed.

In other words, as shown in FIG. 3 the conductor elements 24 is divided into a plurality of blocks, respectively corresponding to the conductor elements 24A constituting the forward path which is wider. The conductor elements 24A each corresponding to the divided block are aligned at equal intervals, i.e., with a constant spacing therebetween. The conductor elements 24A adjacent to each other are serially connected via the chip resistor 23.

The plurality of conductor elements 24A constituting the forward path are arranged on the substrate 22, as shown in FIG. 3, such that two rows of the conductor elements 24A each extending in the longitudinal direction of the substrate 22 are aligned in the width direction thereof. In addition, the conductor elements 24A aligned in the width direction are connected to each other via the chip resistor 23. Thus, the plurality of conductor elements 24A arranged in two rows form a single conductor pattern constituting the forward path.

Figure 4:
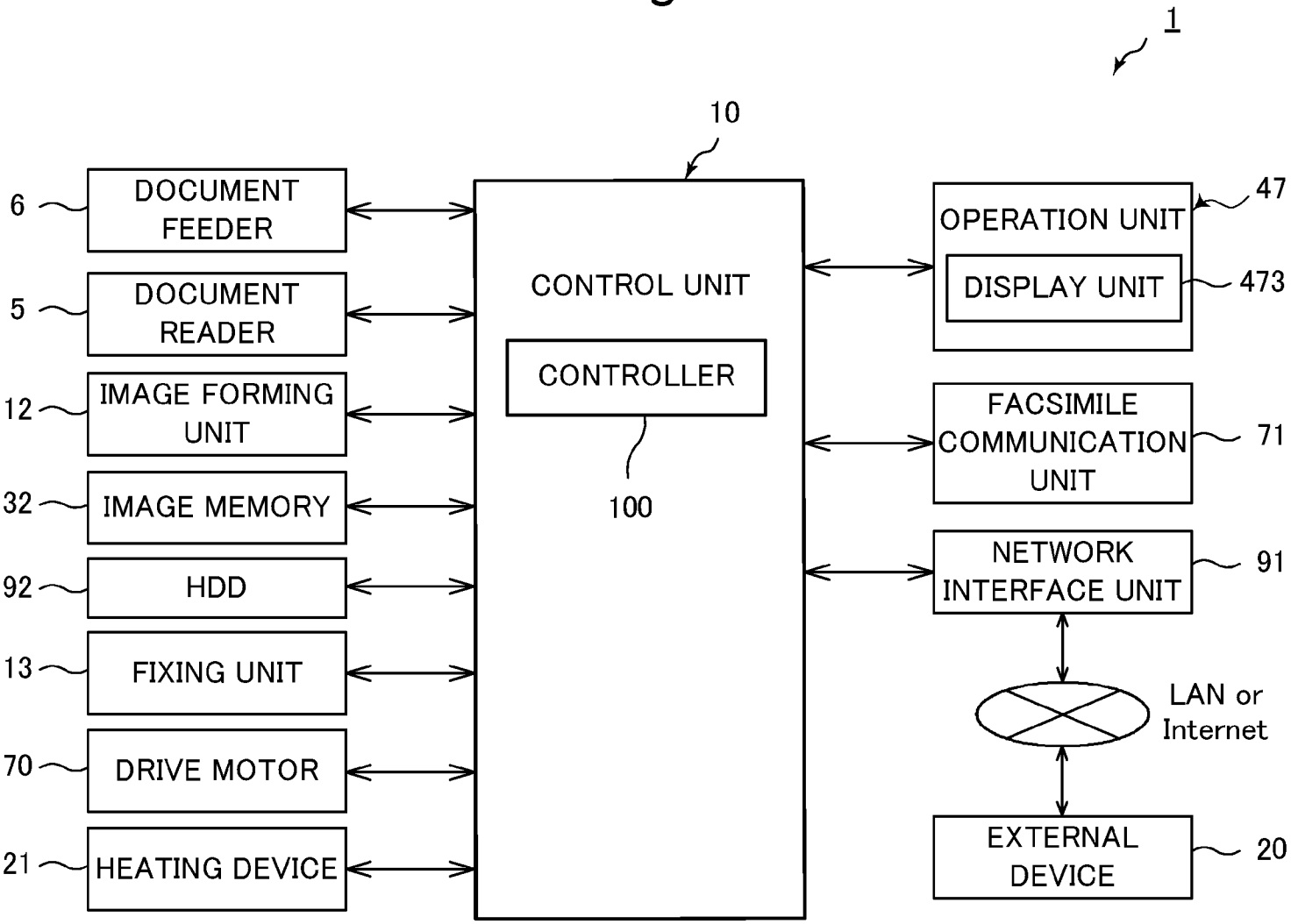
FIG. 4 is a functional block diagram showing an essential internal structure of the image forming apparatus according to the embodiment of the disclosure.

FIG. 4 is a functional block diagram showing an essential internal configuration of the image forming apparatus 1. The image forming apparatus 1 includes a control unit 10, the document feeder 6, the document reader 5, the image forming unit 12, an image memory 32, the HDD 92, the fixing unit 13, a drive motor 70, the heating device 21, the operation unit 47, a facsimile communication unit 71, and a network interface unit 91. The constituents described above with reference to FIG. 1 are given the same numeral, and the description thereof will not be repeated.

The document reader 5 includes a reading mechanism 163 (see FIG. 1) including a light emitting unit and a charge coupled device (CCD) sensor, to be controlled by the controller 100 in the controller 10. The document reader 5 illuminates the source document with the light from the light emitting unit and detects the reflected light with the CCD sensor, to thereby read the image on the source document.

The image memory 32 is a region for temporarily storing the image data of the source document acquired by the document reader 5, and data to be printed by the image forming unit 12. The HDD 92 is a large-capacity storage device for storing source images acquired by the document reader 5, and so forth.

The driving motor 70 is a drive source that provides a rotational driving force to rotational components and the transport roller pair 19 of the image forming unit 12. The facsimile communication unit 71 includes, though not shown, an encoding/decoding unit, a modem, and a network control unit (NCU), to perform facsimile transmission through a public circuit.

The heating device 21 serves to heat up the surface of the photoconductor drums 121M, 121C, 121Y, and 121Bk shown in FIG. 2 thus dehumidifying the same, and is turned on and off by the controller 100. In other words, the controller 100 switches on and off the power supply from the power source VCC. The heating device 21 is turned on by the controller 100 in a standby mode during which the image forming operation is not performed, to generate heat and dehumidify the surface of the photoconductor drums 121M, 121C, 121Y, and 121Bk.

The network interface unit 91 includes a communication module such as a local area network (LAN) board, to transmit and receive data to and from an external device 20 such as a personal computer in the local area or in the Internet, through the LAN connected to the network interface unit 91.

The control unit 10 includes a central processing unit (CPU), a random access memory (RAM), a read only memory (ROM), and an exclusive hardware circuit, and also includes the controller 100 which controls the overall operation of the image forming apparatus 1. The control unit 10 acts as the controller 100 by operating in accordance with an image processing program installed in the HDD 92. However, the controller 100 may be constituted of hardware circuits, instead of being operated by the control unit 10 in accordance with the image processing program. This also applies to other embodiments, unless otherwise specifically noted.

As described thus far, in the foregoing embodiment the substrate 22 is implemented with the conductor pattern 24 arranged so as to serially connect the plurality of chip resistors 23, and the conductor pattern 24 connecting the chip resistors 23 is wider in the forward path from the power source VCC than in the backward path. With such a configuration, the majority of the heat generated by the chip resistor 23 is transmitted from the chip resistor 23 to the conductor pattern 24, more particularly to the conductor elements 24A, and such transmitted heat is radiated from the conductor elements 24A. Accordingly, not only the heat from the surface of the chip resistor 23 but also the heat radiation from the conductor elements 24A serves as heat source. Therefore, heat can be evenly supplied from a broad region on the substrate 22, so as to properly and uniformly heat up the surface of the photoconductor drums 121M, 121C, 121Y, and 121Bk which are the object of heating. In addition, the temperature increase can be prevented from concentrating at a specific position on the substrate 22, and resin materials or the like in the vicinity of the heat concentration position can be exempted from being subjected to a temperature exceeding an upper temperature limit.

For example, when the image forming apparatus is used in a district where the humidity is high, the dehumidification is frequently performed immediately before the start of the image forming operation, and hence the start of the image forming operation is delayed, which leads to degraded printing efficiency. Here, a photosensitive body heater disposed in close contact with the entirety of the inner circumferential surface of a photosensitive body, and a heater that suppresses corrosion of an aluminum wiring pattern are already known. In addition, for dehumidifying the surface of the photosensitive body before the start of the image forming operation, techniques of utilizing a heat generating device such as a resistor and a semiconductor as heat generator for preventing dew condensation are already known. However, with such techniques the heat is unevenly generated and it is hence difficult to properly heat up the object to be heated. Besides, the uneven heat generation may cause the temperature increase to concentrate at a specific position, so that resin materials located close to such a position may be subjected to a temperature exceeding an upper temperature limit.

However, the heating device 21 according to the foregoing embodiment uniformly heats up the object properly with a small power consumption, so as to dehumidify, for example, the surface of the photoconductor drums 121M, 121C, 121Y, and 121Bk to thereby maintain the quality of the image forming operation.

In addition, the controller 100 causes the heating device 21 to generate heat in a standby mode during which the image forming operation is not performed, to prevent dew condensation on the surface of the photoconductor drums 121M, 121C, 121Y, and 121Bk. In other words, the controller 100 supplies the power from the power source VCC to the plurality of chip resistors 23, in the standby mode during which the image forming operation is not performed by the image forming unit 12. Such an arrangement eliminates the need to perform the dehumidification to remove the moisture immediately before starting the image forming operation. Therefore, the dehumidification of the surface of the photoconductor drums 121M, 121C, 121Y, and 121Bk can be properly performed by uniformly and properly heating up the photoconductor drums, the object to be heated, with a small power consumption, and resultantly the quality of the image forming operation can be maintained at a high level.

To enhance the dehumidification effect, it is preferable to set the temperature of the photoconductor drums 121M, 121C, 121Y, and 121Bk to 5 to 10 degrees centigrade higher than the outside temperature. This may be realized, for example by providing a sensor that measures the outside temperature and sensors that measure the temperature of the photoconductor drums 121M, 121C, 121Y, and 121Bk, and comparing the temperature between the sensors to thereby control the current supplied to the chip resistor 23 with the controller 100, on the basis of the comparison result.

In the foregoing embodiment, further, the chip resistors 23 are aligned at equal intervals, and the conductor pattern 24 is arranged such that the conductor elements 24A are evenly located, and therefore the temperature of the surrounding air can be uniformly increased. Making the conductor elements 24A larger in size allows a broader region on the substrate 22 to serve as heat source, and therefore it is preferable to form the conductor elements 24A in a size as large as possible within the restriction from the viewpoint of the layout and circuit characteristics.

Further, the temperature increase at an end portion of the substrate 22 may be smaller than in the central portion. Accordingly, as another embodiment, an increased number of chip resistors 23 may be provided at the end portion of the substrate 22, to thereby secure the same temperature increase at the end portion also, as in the central portion.

Although the conductor pattern 24 is formed of copper in the foregoing embodiment, a different metal may be adopted in the disclosure, for example silver, which has a higher heat dissipation property than copper.

The configuration and processing of the foregoing embodiments described with reference to FIG. 1 to FIG. 4 are merely exemplary, and the configuration and processing of the disclosure are in no way limited to the embodiments.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A heating device comprising:

a plurality of heat generators that generate heat upon receiving power from a power source; and a substrate including a conductor pattern arranged so as to serially connect the plurality of heat generators to thereby supply the power from the power source to each of the heat generators, wherein the conductor pattern includes a plurality of first conductor elements constituting a forward path from the power source and a second conductor element constituting a backward path from the power source, and each of the plurality of first conductor elements are wider than the second conductor element;

the plurality of first conductor elements constitute two rows of conductor patterns by being aligned at equal intervals on the substrate, one of the two rows being arranged in an orthogonal direction to the aligned direction of the other row;

among the plurality of first conductor elements, the first conductor elements aligned in the orthogonal direction are connected to each other via the heat generators, thereby serially connecting the heat generators to each other, and a single conductor pattern constituting the forward path is formed to thereby supply the power from the power source to each of the heat generators; and the second conductor element is not connected to the heat generators.

2. The heating device according to claim 1, wherein the plurality of heat generators are aligned at equal intervals.

3. The heating device according to claim 1, wherein a larger number of the heat generators are provided at an end portion of the substrate in a longitudinal direction of the substrate, than in a central portion of the substrate in the longitudinal direction.

4. The heating device according to claim 1, wherein a portion of the plurality of first conductor elements constituting the forward path is formed in a maximal size within restriction imposed by a layout and circuit characteristics.

5. An image forming apparatus comprising:

an image forming unit that forms a toner image on a surface of a photosensitive body, and transfers the toner image onto a recording medium; and the heating device according to claim 1 located in a vicinity of the photosensitive body.

6. The image forming apparatus according to claim 5, further comprising a control unit that controls power supply from the power source, wherein the control unit causes the power source to supply power to the plurality of heat generators, in a standby mode during which an image forming operation is not performed by the image forming unit.

* * * * *